United States Patent [19]

Kawakami et al.

[11] Patent Number: 4,888,321

[45] Date of Patent: Dec. 19, 1989

[54] HEAT-SENSITIVE RECORDING MATERIALS

[75] Inventors: Hiroshi Kawakami; Akira Igarashi; Ken Iwakura, all of Shizuoka, Japan

[73] Assignee: Fuji Photo Film Co., Ltd., Kanagawa, Japan

[21] Appl. No.: 146,629

[22] Filed: Jan. 21, 1988

[30] Foreign Application Priority Data

| | | | |
|---|---|---|---|
| Jan. 23, 1987 | [JP] | Japan | 62-13777 |
| Mar. 9, 1987 | [JP] | Japan | 62-53483 |
| Mar. 10, 1987 | [JP] | Japan | 62-54636 |
| Mar. 11, 1987 | [JP] | Japan | 62-56325 |
| Mar. 11, 1987 | [JP] | Japan | 62-56326 |

[51] Int. Cl.[4] ..... B41M 5/18

[52] U.S. Cl. ..... 503/208; 427/152; 428/913; 428/914; 503/200; 503/209; 503/226

[58] Field of Search ..... 503/208, 209, 226, 200; 427/150–152; 428/913, 914

[56] References Cited

U.S. PATENT DOCUMENTS 4,480,052 10/1984 Ichijima et al. ..... 503/208

FOREIGN PATENT DOCUMENTS 0204391 10/1985 Japan ..... 503/226

*Primary Examiner*—Bruce H. Hess

*Attorney, Agent, or Firm*—Sughrue, Mion, Zinn, Macpeak & Seas

[57] ABSTRACT

A heat-sensitive recording material comprising a support having thereon a subbing layer mainly composed of a pigment and a binder, and a heat-sensitive coloring layer, wherein the subbing layer and the heat-sensitive recording layer each contains a heat-fusible material having a melting point of at least 50° C.

3 Claims, No Drawings

HEAT-SENSITIVE RECORDING MATERIALS

FIELD OF THE INVENTION

This invention relates to a heat-sensitive recording material, and more particularly to a heat-sensitive recording material having a heat-sensitive coloring layer and a subbing layer.

BACKGROUND OF THE INVENTION

Various systems are known for heat-sensitive recording. For example, heat-sensitive recording materials using an electron donating dye precursor and an electron accepting compound are disclosed in Japanese Patent Publication Nos. 14039/70 and 4160/68. Also, heat-sensitive recording materials using a diazo compound are disclosed in Japanese Patent Application (OPI) No. 190886/84 (the term "OPI" as used herein refers to a "published unexamined Japanese patent application").

Recently, these heat-sensitive recording systems have been employed in various fields, such as facsimiles, printers, labellers, etc., and the need thereof have been rapidly increased. With such requirements, characteristics not previously required are now important factors. One of these characteristics is the reproducibility of print dots. In general, printout on a heat-sensitive recording paper is obtained by heating the heat-sensitive paper with a fine heating element of about 100 $\mu m \times 200$ $\mu m$ in point area usually called a "thermal head" and it has been found to be important for obtaining a printout of high quality to reproduce faithfully the form of the fine heating element as a colored image or spot. This is called "print dot reproducibility".

Also, to fulfill the aforesaid requirement, incorporation of a heat-fusible material in a subbing layer of a heat-sensitive recording material has been proposed (Japanese Patent Application (OPI) No. 184691/84) but satisfactory print dot reproducibility has not yet been obtained.

SUMMARY OF THE INVENTION

An object of this invention is, therefore, to provide a heat-sensitive recording material showing good print dot reproducibility and providing a high quality printout.

As the result of various investigations, it has been now discovered that the aforesaid object can be attained by the present invention as set forth hereinbelow.

Accordingly, this invention provides a heat-sensitive recording material comprising a support, a subbing layer containing a pigment and a binder as the main components formed on the support, and a heat-sensitive coloring layer formed on the subbing layer, wherein the subbing layer and the heat-sensitive coloring layer each contains the same or different heat-fusible material having a melting point of at least 50° C.

DETAILED DESCRIPTION OF THE INVENTION

The heat-sensitive recording material of this invention comprises a support, a subbing layer containing a pigment and a binder as main components, and a heat-sensitive coloring layer formed on the subbing layer.

Suitable supports for use in this invention are based papers, wood free papers, synthetic papers, plastic sheets, neutral papers, etc.

Examples of pigments which can be used for the subbing layer in this invention include general organic or inorganic pigments but pigments having an oil absorptiveness (as defined by JIS-K 5101, JIS refers to Japanese Industrial Standard) of at least 40 cc/100 g are preferred and specific examples of these pigments are calcium carbonate, barium sulfate, titanium oxide, talc, agalmatolite, kaolin, calcined kaolin, aluminum hydroxide, amorphous silica, urea formalin resin powders, polyethylene resin powders, etc.

Exemplary binders for the subbing layer are water-soluble polymers and water-insoluble binders. The binders may be used alone or as a mixture thereof.

Particular examples of water-soluble polymers for use as the binder are methyl cellulose, carboxymethyl cellulose, hydroxyethyl cellulose, starches, gelatin, gum arabic, casein, a styrene-maleic anhydrode copolymer hydrolyses product, an ethylene-maleic anhydride copolymer hydrolyses product, an isobutylene-maleic anhydrode copolymer hydrolyses product, polyvinyl alcohol, carboxy-denatured polyvinyl alcohol, polyacrylamide, etc.

Also, synthetic rubber latexes and synthetic resin emulsions are generally used as the water-insoluble binders and specific examples thereof are a styrene-butadiene rubber latex, an acrylonitrile-butadiene rubber latex, a methyl acrylate-butadiene rubber latex, a vinyl acetate emulsion, etc.

The amount of the binder is from 3% to 100%, preferably from 5% to 50% to the amount of pigment.

The subbing layer may further contain, if desired, a wax, a decoloring preventing agent, a surface active agent, etc.

The heat-sensitive coloring layer for use in this invention contains an electron donating dye precursor (hereinafter, referred to as a color former) and an electron accepting compound (hereinafter, referred to as a developer) together with a heat-fusible material as a feature of this invention.

Suitable color formers which can be used for the heat-sensitive coloring layer in this invention are various kinds of compounds, such as triphenylmethane phthalide series compounds, fluoran series compounds, phenothiazine series compounds, indolylphthalide series compounds, leucoauramine series compounds, rhodaminelactam series compounds, triphenylmethane series compounds, triazene series compounds, spiropyran series compounds, fluorene series compounds, etc. They may be used alone or as a mixture thereof.

Specific examples of phthalides are described in U.S. Reissue Pat. No. 23,024, U.S. Pat. Nos. 3,491,111, 3,491,112, 3,491,116, 3,509,174, etc., specific examples of fluorans are described in U.S. Pat. Nos. 3,624,107, 3,627,787, 3,641,011, 3,462,828, 3,681,390, 3,920,510, 3,959,571, etc., specific examples of spirodipyrans are described in U.S. Pat. No. 3,971,808, etc., pyridine series and pyrazine series coloring compounds are described in U.S. Pat. Nos. 3,775,424, 3,853,869, 4,246,318, and fluorene series compounds are described in Japanese Patent Application No. 240989/86.

These color formers are illustrated in greater detail below.

Specific examples of triphenylmethanephthalide series compounds are 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,2-dimethylindol-3-yl)phthalide, 3-(4-diethylamino-2-ethoxyphenyl)-3-(1-ethyl-2-methylindol-3-yl)phthalide, etc.

Specific examples of diphenylmethane series compounds are 4,4'-bis-dimethylaminopenzhydrin benzyl ether, N-halophenyl laucoauramine, N-2,4,5-trichlorophenyl leucoauramine, etc.

Specific examples of xanthene series compounds are rhodamine-B-anilinolactam, rhodamine(p-nitrino)lactam, 2-(dibenzylamino)fluoran, 2-phenylamino-6-diethylaminofluoran, 2-(o-chloroanilino)-6-diethylaminofluoran, 2-(3,4-dichloroanilino)-6-diethylaminofluoran, 2-anilino-3-methyl-6-piperidinofluoran, 2-phenyl-6-diethylaminofluoran, 3,6-bis(diphenylamino)fluoran, etc.

Specific examples of thiazine series compounds are benzoleucomethylene blue, p-nitrobenzylleucomethylene blue, etc.

Representative examples of spiropyran series compounds are 3-methyl-spiro-dinaphthopyran, 3-ethyl-spiro-dinaphthopyran, 3,3'-dichloro-spiro-dinaphthopyran, 3-benzylspiro-dinaphthopyran, 3-methyl-naphtho-(3-methoxybenzo)spiropyran, 3-propyl-spiro-dibenzopyran, etc.

These compounds may be used alone or as a mixture thereof.

Of the aforesaid compounds, triarylmethane series compounds (e.g., Crystal Violet Lactone, 3-(4-dialkylamino-2-alkoxyphenyl)-3-(1-alkyl-2-methylindol-3yl)phthalide, 3-(4-dialkylamino-2-alkoxyphenyl)-3-(1-alkyl-2-methylindol-3-yl)-4-azaphthalide, etc) and xanthene series compounds (e.g., 3,6-bisdiarylaminofluoran, 2-substituted amino-6substituted aminofluoran, etc.) are preferred since they result in less fog and provide high coloring density.

More preferred color formers are xanthene series compounds represented by formula (I)

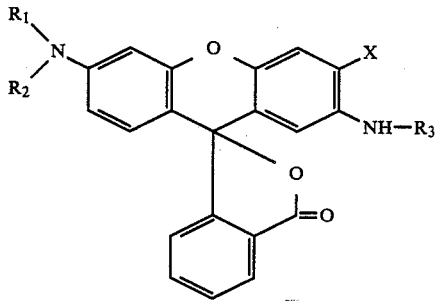

(I)

wherein $R_1$ and $R_2$, which may be the same or different, each represents an alkyl group having, preferably from 1 to 10 carbon atoms, where the alkyl group may be a straight chain, branched, or cyclic group and may have a substituent, furthermore, $R_1$ and $R_2$ may combine to form a 5-membered to 7-membered ring containing a hetero atom; $R_3$ represents an aryl group having, preferably from 6 to 20 carbon atoms, and particularly preferably a phenyl group or a substituted phenyl group (an alkyl group having from 1 to 10 carbon atoms is preferred as the substituent for the phenyl group); and X represents a hydrogen atom, an alkyl group having from 1 to 10 carbon atoms, an alkoxy group, a phenyl group, or a halogen atom.

Specific examples of these color formers are illustrated below but the color formers for use in this invention are not limited to these compounds.

Specifically, such compounds include 2-anilino-3-methyl-6-dimethylaminofluoran, 2-anilino-3-methyl-6-N-methyl-N-ethylaminofluoran, 2-anilino-3-methyl-6-N-methyl-N-(iso-propyl)aminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethylaminofluoran, 2-anilino-3-chloro-6-dimethylaminofluoran, 2-anilino-3-methyl-6-N-ethyl-N-isoamylaminofluoran, 2-anilino-3-methyl-6-N-methyl-N-isoamylaminofluoran, 2-anilino-3-chloro-6-diethylaminofluoran, 2-anilino-3-chloro-6-N-methyl-N-ethylaminofluoran, 2-anilino-3-chloro-6-N-methyl-N-(iso-propyl)amino-fluoran, 2-anilino-3-chloro-6-N-methyl-N-pentylaminofluoran, 2-anilino-3-chloro-6-N-methyl-N-cyclohexylaminofluoran, 2-anilino-3-methyl-6-N-ethyl-N-pentylaminofluoran, 2-anilino-3-chloro-6-N-ethyl-N-pentylaminofluoran, 2-(p-methylanilino)-3-methyl-6-dimethylaminofluoran, 2-(p-methylanilino)-3-methyl-6-diethylaminofluoran, 2-(p-methylanilino)-3-methyl-6-N-methyl-N-ethylaminofluoran, 2-(p-methylanilino)-3-methyl- 6-N-methyl-N-(iso-propyl-)aminofluoran, 2-(p-methylanilino)-3-methyl-6-N-methyl-N-pentylaminofluoran, 2-(p-methylanilino)-3-methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6-diethylaminofluoran, 2-(p-methylanilino)-3-chloro-6-N-methyl-ethylaminofluoran, 2-(p-methylanilino)-3-chloro-6-N-methyl-N-(iso-propyl)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-allylmethylaminofluoran, 2-anilino-3-ethyl-6-N-methyl-N-furylmethylaminofluoran, 2,2-bis[4-{6'-(N-ethyl-N-isoamino)-3'-methylspyro[phthalido-3,9'-xanthene]-2'-ylamino}phenyl]propane, etc.

These compounds may be used alone or may be used as a mixture thereof for controlling tone and for preventing colored image fading.

The preferred coating amount of the color former is 0.1 to 1.0 g/m$^2$, more preferably 0.2 to 0.8 g/m$^2$.

As the developers which are used for the heat-sensitive coloring layer of this invention, the compounds represented by following formula (II) to (V) are preferably used:

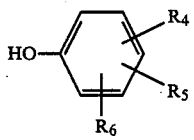

(II)

wherein, $R_4$ and $R_5$, which may be the same or different, each represents a hydrogen atom, an alkyl group, an alkoxy group, an aryl group, an arylsulfonyl group, an alkoxycarbonyl group, an aryloxycarbonyl group, an N-substituted carbamoyl group, or a halogen atom and $R_6$ represents a hydrogen atom or a group shown by formula (VI)

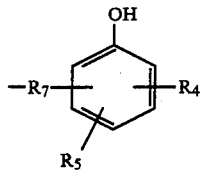

(VI)

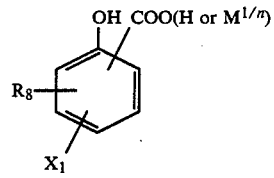

(III)

wherein $R_4$ and $R_5$ are the same as $R_4$ and $R_5$ in formula (II) described above and $R_7$ represents a divalent group having from 1 to 12 carbon atoms or an —$SO_2$— group.

Of the compounds shown by formula (II) described above, the compounds of formula (II), wherein $R_6$ is a hydrogen atom and $R_4$ and $R_5$ are a hydrogen atom or an alkoxycarbonyl group and the compounds of formula (II), wherein $R_6$ is the group shown by formula (VI) above and $R_7$ is an alkylene group having from 1 to 12 carbon atoms, a cycloalkylene group having from 5 to 7 carbon atoms, an aralkylene group having from 8 to 12 carbon atoms, —CO—, or —$SO_2$— are preferred.

Suitable alkyl groups in the aforesaid formulae include a saturated or unsaturated alkyl group or cycloalkyl group and these groups may have a substituent such as an aryl group, an alkoxy group, an aryloxy group, a halogen atom, a cyano group, etc.

Specific examples of developers shown by formula (II) described above are 4-phenylphenol, bisphenolsulfone, p-phenylsulfonylphenol, p-tolylsulfonylphenol, bis(3-vinyl-4-hydroxyphenyl)sulfone, 2,2-bis(3-vinyl-4-hydroxyphenyl)propane, bis-3-allyl-4-hydroxyphenylsulfone, hexyl-4-hydroxy benzoate, 2,2'-dihydroxyphenyl, 2,2-bis(4-hydroxyphenyl)propane (or bisphenol A), 4,4'-isopyridenebis(2-methylphenol), 1,1-bis(3-chloro-4-hydroxyphenyl)cyclohexane, 1,1-bis(3-chloro-4-hydroxyphenyl)-2-ethylbutane, 4,4'-sec-isooctylidenediphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-bis(4'-hydroxycumyl)benzene, bis(3-allyl-4-hydroxyphenyl)sulfone, 1,3-bis(4'-hydroxycumyl)benzene, 4,4'-thiobis(6-tert-butyl-3-methylphenol), 4,4'-dihydroxydiphenylsulfone, hydroquinonemonobenzyl ether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, 4-hydroxybenzoic acid α-phenylbenzyl ester, phenylpropyl 4-hydroxybenzoate, phenetyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethyl orsellinate, cynnamyl orsellinate, o-chlorophenoxyethyl orsellinate, o-ethylphenoxyethyl orsellinate, o-ethylphenoxyethyl orsellinate, m-phenylphenoxyethyl orsellinate, 2,4-dihydroxybenzoic acid β-3'-t-butyl-4'-hydroxyphenoxyethyl ester, 1-t-butyl-4-p-hydroxyphenylsulfonyloxybenzene, 4-N-benzylsulfamoylphenol, p-methylbenzyl 2,4-dihydroxybenzoate, β-phenoxyethyl 2,4-dihydroxybenzoate, 2,4-dihydroxy-6-methylbenzoic acid benzyl ester, methyl bis-4-hydroxyphenylacetate, etc.

wherein $R_8$ represents a hydrogen atom, a halogen atom, a hydroxy group, an acyl group, an aryl group, or an alkyl group; $X_1$ represents an alkyl group, an alkoxy group, or a halogen atom; M represents an n-valent metal atom; and n represents an integer of from 1 to 3.

In addition, the alkyl group in the above formula includes a saturated or unsaturated alkyl group and cycloalkyl group and these groups may have a substituent such as an aryl group, an alkoxy group, an aryloxy group, a halogen atom, an acylamino group, an aminocarbonyl group, a cyano group, etc. Also, the aryl group in the above formula includes a phenyl group, a naphthyl group, and a heterocyclic aromatic group and these groups may have a substituent such as an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

In formula (III) described above, $R_8$ is preferably a hydrogen atom, an phenyl group, or an alkyl group having from 1 to 22 carbon atoms; $X_1$ is preferably an alkyl group having from 1 to 22 carbon atoms, an alkoxy group having from 1 to 20 carbon atoms, a chlorine atom, or a fluorine atom; and M is preferably zinc, aluminum, magnesium or calcium.

Suitable preferred substituents for the alkyl group and alkoxy group shown by $X_1$ in formula (III) are an aryl group having from 6 to 12 carbon atoms, an aryloxy group having from 6 to 16 carbon atoms, an alkoxy group having from 1 to 12 carbon atoms, a halogen atom, and an alkoxycarbonyl group.

It is preferred from the view point of water insolubility for the salicylic acid derivatives shown by formula (III) described above for use in this invention to have a total number of carbon atoms of at least 14, and particularly at least 16. These salicylic acid derivatives may be used in the form of metal salts or may be used in the form of a dispersion thereof containing, for example, zinc oxide to form a salt thereof in the dispersion or adsorb zinc on the derivative or further double decomposition to occur.

Specific examples of salicylic derivatives shown by formula (III) described above are 4-pentadecylsalicylic acid, 3-phenylsalicylic acid, 3-cyclohexylsalicylic acid, 3,5-di-t-butylsalicylic acid, 3,5-di-dodecylsalicylic acid, 3-methyl-5-benzylsalicylic acid, 3-phenyl-5-(α,α-dimethylbenzyl)salicylic acid, 3,5-di(α-methylbenzyl)salicylic acid, 3,5-di-t-octylsalicylic acid, 5-tetradecylsalicylic acid, 5-hexadecylsalicylic acid, 5-octadecylsalicylic acid, 5-α-(p-α-methylbenzylphenyl)ethylsalicylic acid, 4-dodecyloxysalicylic acid, 4-tetradecyloxysalicylic acid, 4-hexadecyloxysalicylic acid, 4-β-phenoxyethoxysalicylic acid, 4-β-p-tolyloxyethoxysalicylic acid, 4-β-p-ethylphenoxyethoxysalicylic acid, 4-β-p-methoxyphenoxyethoxysalicylic acid, 4-β-p-ethoxyphenoxyethoxysalicylic acid, 4-β-m-tolyloxyethoxysalicylic acid, 4-β-o-tolyloxyethoxysalicylic acid, 4-(8-phenoxyoctyloxy)salicylic acid, etc.

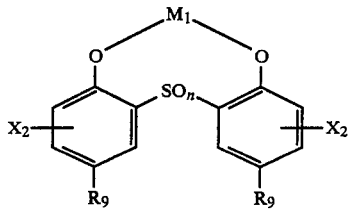

(IV)

wherein $R_9$ represents a hydrogen atom, an aryl group, an alkyl group, or a halogen atom; $X_2$ represents a hydrogen atom, an alkyl group, an alkoxy group, a carboxy group, or a halogen atom; $M_1$ represents a divalent metal; and n represents an integer of from 1 to 3.

Specific examples of developers shown by formula (IV) are the zinc salt, nickel salt, magnesium salt, etc., of bis(2-hydroxy-5-butylphenyl)sulfone, bis(2-hydroxy-5-phenylphenyl)sulfone, bis(2-hydroxy-5-octylphenyl)-sulfone, bis(2-hydroxy-5-chlorophenyl)sulfone, bis(2-hydroxy-3-chloro-5-butylphenyl)sulfone, etc.

$$(R_{10})_2 2N(A)_2 \quad (V)$$

wherein $R_{10}$ represents an unidentate or polydentate colorless organic ligand forming a complex by bonding to a zinc ion through a hetero atom and A represents SCN, a chlorine atom or a benzoic acid anion having an electron attracting group.

In the colorless organic ligands shown by $R_{10}$, a pyridine ligand, an imidazole ligand, a quinoline ligand, a benzothiazole digand, a benzoimidazole ligand, and an antipyrine ligand are preferred. These ligands may be substituted with an alkyl group, a cyano group, an alkoxy group, a phenyl group, an amino group, a formyl group, a hydroxy group, a vinyl group, etc.

Specific examples of developers shown by formula (V) described above are an imidazole complex, a 2-phenylimidazole complex, a picoline complex, a pyridine complex, a 2-benzylimidazole complex, a benzoimidazole complex, a 2,3-dimethyl-1-phenyl-3-pyrazolin-5-one complex, 1-phenyl-2-methyl-3-benzyl-3-pyrazoline-5-one complex, a 1-phenyl-2-methyl-3-(2-ethylhexyl)-3-pyrazolin-5-one complex, a 1-phenyl-2-methyl-3-isopropyl-3-pyrazolin-5-one complex, a 1-phenyl-2,3-dibenzyl-pyrazolin-5-one complex, a 1-phenyl-2-benzyl-3-methyl-pyrazolin-5-one complex, etc., of zinc rhodanide. They may be used alone or as a mixture thereof.

The preferred coating amount of the developer is 0.2 to 3.0 g/m$^2$, more preferably 0.3 to 2.0 g/m$^2$.

A main feature of this invention is that the subbing layer and the heat-sensitive coloring layer of the heat-sensitive recording layer as described above contain a heat-fusible material having a melting point of at least 50° C. In a first embodiment of this invention, heat-fusible materials having a melting point of at least 50° C. include the ethers, esters, amide compounds, waxes, and phenol derivatives described hereinbelow. Examples of heat-fusible organic compounds which are ethers, esters or amide compounds are represented by following formulae (VI) to (IX):

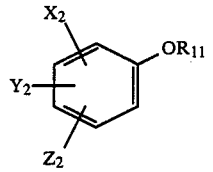

(VI)

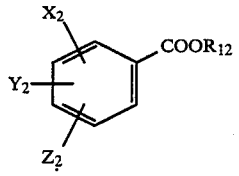

(VII)

$$R_{13}CONHR_{14} \quad (VIII)$$

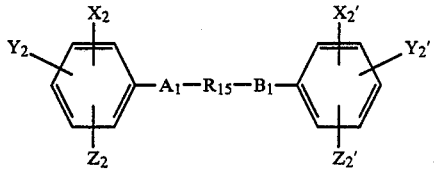

(IX)

In the above formulae, $R_{11}$, $R_{12}$, and $R_{13}$, which may be the same or different, each represents an alkyl group or an aryl group; $R_{14}$ represents a hydrogen atom, an alkyl group, or an aryl group; $R_{15}$ represents a di-valent group; $A_1$ and $B_1$, which may be the same or different, each represents O, $CO_2$, or S; $X_2$, $Y_2$, $Z_2$, $X_2'$, $Y_2'$, and $Z_2'$, which may be the same or different, each represents a hydrogen atom, an alkyl group, an aryl group, an alkoxy group, a halogen atom, an alkyloxycarbonyl group, an acyloxy group, or an alkylthio group; $X_2$ and $Y_2$ or $X_2'$ may combine with each other to form a ring.

In the aforesaid formulae, the alkyl group includes a saturated or unsaturated alkyl group and a cycloalkyl group and these groups may have a substituent such as an aryl group, an alkoxy group, an aryloxy group, a halogen atom, an acylamino group, an aminocarbonyl group, a cyano group, etc. Also, the aryl group includes a phenyl group, a naphthyl group and a heterocyclic aromatic group and these groups may have a substituent such as an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, or a phenyl group.

In the above-described formulae, $R_{11}$, $R_{12}$, $R_{13}$, and $R_{14}$ are preferably an alkyl group having from 1 to 20 carbon atoms, which may have a substituent, or an aryl group having from 6 to 20 carbon atoms, which may have a substituent. Suitable preferred substituents for the alkyl or aryl group are an aryl group, an alkyl group, an alkoxy group, an aryloxy group, or a halogen atom. Also, in the groups shown by $R_{15}$, an alkylene group, an alkylene group having an ether bond, an alkylene group having a carbonyl moiety, an alkylene group having a halogen atom, and an alkylene group having an unsaturated bond are preferred, and further an alkylene group and an alkylene group having an ether bond are more preferred.

Specific examples of heat-fusible materials shown by formulae (VI) to (IX), described above are benzyl p-benzyloxybenzoate, β-naphthylbenzyl ether, β-naphthoic acid phenyl ester, 1-hydroxy-2-naphthoic acid phenyl ester, β-naphthol-(p-chlorobenzyl) ether, α-naphthol(p-methylbenzyl) ether, α-naphthylbenzyl ether, 1,4-butanediol-p-methylphenyl ether, 1,4-butanediol-p-isopropylphenyl ether, 1,4-butanediol-p-t-octylphenyl ether, 2-phenoxy-1-p-tolyloxyethane, 1-phenoxy-2-(4-ethylphenoxy)ethane, 1-phenoxy-2-(4-chlorophenoxy)ethane, 1,4-butanediol diphenyl ether, (4,4'-methoxyphenylthio)ethane, benzoic acid phenyl ester, benzoic acid p-methoxyphenyl ester, benzoic acid p-chlorophenyl ester, terephthalic acid dibenzyl ester, benzoic acid (β-p-phenylphenoxyethyl) ester, phenoxyacetic acid p-chlorophenyl ester, phenoxyacetic acid p-methylphenyl ester, phenoxyacetic acid β-naphthyl ester, N-benzylbenzamide, N-octadecylbenzamide, N-benzylphenylacetic acid amide, N-phenylstearic acid amide, etc.

Specific examples of waxes which can be used as the heat-fusible material in this embodiment of this invention are polyethylene wax, carnauba wax, paraffin wax, microcrystalline wax, candelilla wax, montan wax, etc.

Preferred examples of the phenol derivatives include, in particular, hindered phenol compounds, which are used as the heat-fusible organic materials in the embodiment of this invention, and they are the compounds shown by following formulae (X) to (XIII):

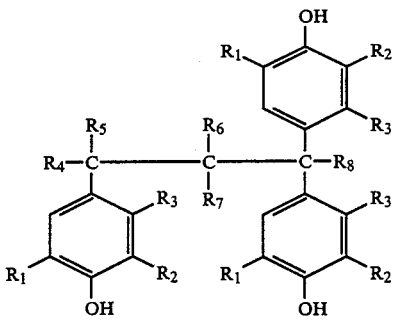

(X)

wherein $R_1$ represents a branched chain alkyl group having from 3 to 8 carbon atoms; $R_2$ represents a hydrogen atom or a branched chain alkyl group having from 3 to 8 carbon atoms; $R_3$ represents a hydrogen atom or an alkyl group having from to 3 carbon atoms; $R_4$ represents a hydrogen atom or an alkyl group having from 1 to 8 carbon atoms; $R_5$, $R_6$, and $R_7$, which may be the same or different, each represents a hydrogen atom or an alkyl group having from 1 to 3 carbon atoms; and $R_8$ represents a hydrogen atom or an alkyl group having from 1 to 8 carbon atoms.

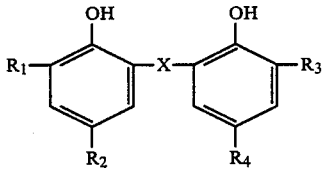

(XI)

wherein $R_1$ and $R_3$, which may be the same or different, each represents a branched chain alkyl group having from 3 to 8 carbon atoms; $R_2$ and $R_4$, which may be the same or different, each represents an alkyl group having from 1 to 8 carbon atoms; X represents S, O, $SO_2$, $S_2$,

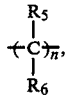

a cyclopentylene group, or a cyclohexylene group; $R_5$ and $R_6$, which may be the same or different, each represents a hydrogen atom or an alkyl group having from 1 to 8 carbon atoms; and n represents an integer of from 0 to 3.

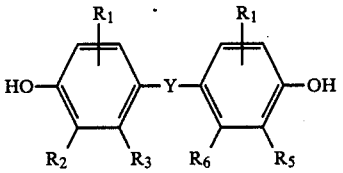

(XII)

wherein $R_1$ and $R_4$ each represents a branched chain alkyl group having from 3 to 8 carbon atoms; $R_2$, $R_3$, $R_5$, and $R_6$, which may be the same or different, each represents a hydrogen atom or an alkyl group having from 1 to 8 carbon atoms; and Y represents S, O, $SO_2$, $S_2$, or

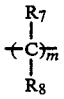

(wherein $R_7$ and $R_8$, which may be the same or different, each represents a hydrogen atom or an alkyl group having from 1 to 8 carbon atoms, and $R_7$ and $R_8$ may combine to form a cyclic pentamethylene group and m represents an integer of from 0 to 3).

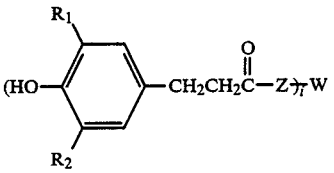

(XIII)

wherein $R_1$ and $R_2$, which may be the same or different, each represents a branched chain alkyl group having from 3 to 8 carbon atoms; Z represents —NH— or $—O(CH_2)_n—$ (wherein n represents an integer of from 1 to 5); i represents an integer of from 1 to 4; and when i is 1, W represents an alkyl group having from 1 to 18 carbon atoms, when i is 2, W represents

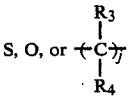

(wherein $R_3$ and $R_4$, which may be the same or different, each represents a hydrogen atom or an alkyl group having from 1 to 8 carbon atoms and j represents an integer of from 0 to 8), when i is 3, W represents $>C—R_5$ (wherein $R_5$ represents a hydrogen atom or an alkyl group having from 1 to 8 carbon atoms), and when i is 4, W represents

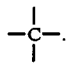

Typical examples of phenol derivatives shown by formulae (X) to (XIII) described above are illustrated below. (A) Examples of phenol derivatives shown by formula (X) described above are 1,1,3-tris(2-methyl-4-hydroxy-5-tertbutylphenyl)butane, 1,1,3-tris(2-ethyl-4-hydroxy-5-tertbutylphenyl)butane, 1,1,3-tris(3,5-di-tert-butyl-4-hydroxyphenyl)butane, 1,1,3-tris(2-methyl-4-hydroxy-5-tert-butylphenyl)propane, etc.

(B) Examples of phenol derivatives shown by formula (XI) are 2,2'-methylene-bis(6-tert-butyl-4-methylphenol), 2,2'-methylene-bis(6-tert-butyl-4-ethylphenol), etc.

(C) Examples of phenol derivatives shown by formula (XII) are 4,4'-butylidene-bis(6-tert-butyl-3-methylphenol), 4,4'-thio-bis(3-methyl-6-tert-butylphenol), etc.

(D) Examples of phenol derivatives shown by formula (XIII) are

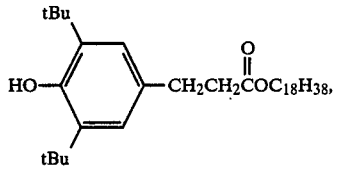

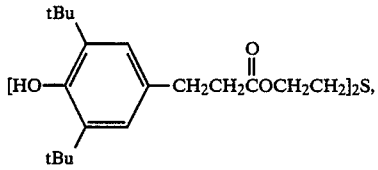

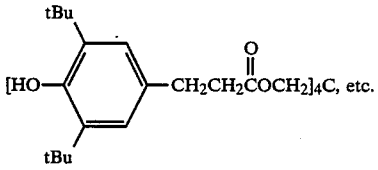

The above-described heat-fusible materials may be used alone or as a mixture thereof. It is preferred that the amount of the heat-fusible material present is from 0.5% by weight to 20% by weight of the subbing layer. In this case, the subbing layer may further contain a surface active agent.

In a second embodiment of this invention, the subbing layer and the heat-sensitive coloring layer of the heat-sensitive recording material of this invention contain the same kind of heat-fusible material having melting point of from 70° C. to 130° C.

Examples of heat-fusible materials which are used in the second embodiment of this invention include organic compounds represented by the following formulae (XIV) to (XVII).

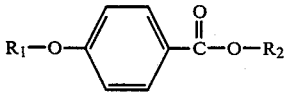

(XIV)

-continued

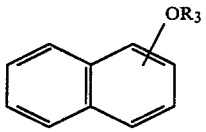

(XV)

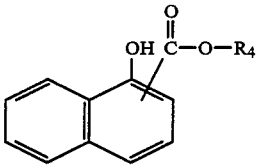

(XVI)

In formulae (XIV) to (XVI), $R_1$, $R_2$, $R_3$ and $R_4$, which may be the same or different, each represents a phenyl group or a benzyl group, and the phenyl or benzyl group may be substituted with a lower alkyl group, a halogen atom, a hydroxy group, or an alkoxy group.

Also, when the phenyl group or benzyl group shown by $R_1$, $R_2$, $R_3$, and $R_4$ in formulae (XIV) to (XVI) described above is substituted with a lower alkyl group, the number or carbon atoms of the group is from 1 to 8, and preferably is from 1 to 3. Also, when the group is substituted by a halogen atom, the preferred halogen atom is chlorine or fluorine.

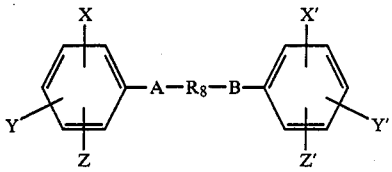

(XVII)

wherein $R_8$ represents a divalent group such as, preferably, an alkylene group having a ether bond, an alkylene group having a carbonyl moiety, an alkylene group having a halogen atom, or an alkylene group having an unsaturated bond, and more preferably is an alkylene group or an alkylene group having an ether bond; A and B, which may be a same or different, each represents O or S; and X, Y, Z, X', Y', and Z', which may be the same or different, each represents a hydrogen atom, an alkyl group, a lower alkoxy group, a lower aralkyl group, a halogen atom, an alkyloxycarbonyl group, an aralkyl group, an oxycarbonyl group.

Specific examples of heat-fusible materials shown by formulae (XIV) to (XVII) are benzyl p-benzyloxybenzoate, β-naphthylbenzyl ether, phenyl β-naphthoate, phenyl 1-hydroxy-2-naphthoate, β-naphthol(p-chlorobenzyl) ether, β-naphthol(p-methylbenzyl) ether, α-naphthylbenzyl ether, 1,4-butandiol-p-methylphenyl ether, 1,4-butanediol-p-methylphenyl ether, 1,4-butanediol-p-isopropylphenyl ether, 1,4-butanediol-p-t-octylphenyl ether, 2-phenoxy-1-p-tolyloxy-ethane, 1-phenoxy-2-(4-ethylphenoxy)ethane, 1-phenoxy-2-(4-chlorophenoxy)ethane, 1,4-butanedioldiphenyl ether, (4,4'-methoxyphenylthio)ethane, etc.

These heat-fusible materials may be used alone or as a mixture thereof.

In a third embodiment of this invention, the subbing layer of the heat-sensitive recording material contains amide derivatives, urea derivatives or urethane derivatives having a melting point of at least 75° C. as the heat-fusible material.

The amide derivatives which can be used for the subbing layer in the 3rd embodiment of this invention are aromatic or aliphatic monobasic acid or dibasic acid derivatives and are preferably shown by the following formulae (XVIII) to (XXII):

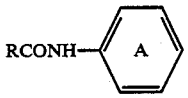

(XVIII)

$RCONHR_1$ (XIX)

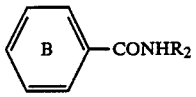

(XX)

$RCONH—X_1—NHCOR$ (XXI)

$R_1NHCO—X_2—CONHR_1$ (XXII)

In the above formulae (XVIII) to (XXII), R, $R_1$ and $R_2$, which may be the same or different, each represents a hydrogen atom or an alkyl group, and R and $R_1$ may combine to form a 5-membered to 12-membered ring; and $X_1$ and $X_2$ each represents a divalent group.

The alkyl group shown by R, $R_1$ or $R_2$ may have a substituent such as, preferably, an aryl group, an aryloxy group, an alkoxy group, a halogen atom, etc.

Also, the aromatic rings A and B in the aforesaid formulae may further have a substituent such as, preferably, an alkyl group, an aralkyl group, an aryl group, an alkoxy group, a halogen atom, etc.

Of the alkyl groups shown by R in above-described formulae (XVIII) to (XXII), an alkyl group having from 1 to 20 carbon atoms, an aryl-substituted alkyl group having from 7 to 20 carbon atoms, and an aryloxy-substituted alkyl group having from 7 to 20 carbon atoms are more preferred.

Also, of the alkyl groups shown by $R_1$ in formula (XIX) described above, an alkyl group having from 1 to 20 carbon atoms, an aryl-substituted alkyl group having from 7 to 20 carbon atoms, and a halogen-substituted alkyl group having from 1 to 20 carbon atoms are more preferred.

Of the alkyl groups shown by $R_2$ in formula (XX) described above, an alkyl group having from 1 to 20 carbon atoms, an aryl-substituted alkyl group having from 7 to 20 carbon atoms, and an alkoxyalkyl group having from 2 to 20 carbon atoms are more preferred.

Of the divalent groups shown by $X_1$ in formula (XXI) described above, a methylene residue having from 2 to 20 carbon atoms,

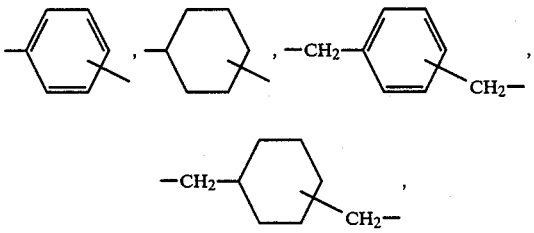

-continued

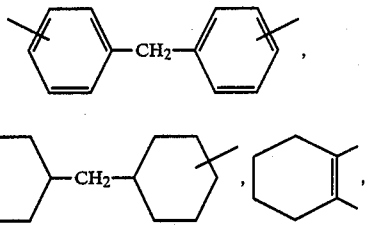

$—CH_2O—X_3—OCH_2$ ($X_3$ has the same meaning as defined on $X_1$), $—C_nH_{2n}(N—C_nH_{2n})_m$ COR (wherein n represents an integer of from 1 to 4; m represents an integer of from 1 to 3; and R is as defined above), etc., are preferred.

Of the divalent groups shown by $X_2$ in formula (XXII) described above, a methylene residue having from 2 to 10 carbon atoms,

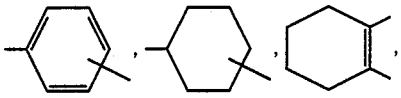

etc., are preferred.

Also, of the substituents for the benzene ring A or B in formula (XVIII) or (XX), an alkyl group having from 1 to 10 carbon atoms, an alkoxy group having from 1 to 10 carbon atoms, and a halogen atom are more preferred.

The urea derivatives and the urethane derivatives which are used for subbing layer as the heat-fusible material in the third embodiment of this invention are shown by following formulae (XXIII) to (XXVI):

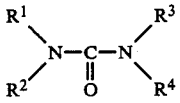

(XXIII)

wherein $R^1$, $R^2$, $R^3$, and $R^4$, which may be the same or different, each represents a hydrogen atom, a substituted or unsubstituted alkyl group or substituted or unsubstituted aryl group, and further $R^4$ represents

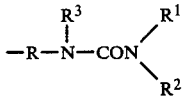

(wherein R represents an alkylene group, an allylene group, an aralkylene group, or an oxyalkylene group and $R^1$, $R^2$, and $R^3$ have the same significance as in formula (XXIII).

In formula (XXIIII) described above, the total number of carbon atoms of the groups shown by $R^1$, $R^2$, $R^3$, and $R^4$ is at least 6.

Of the alkyl groups shown by $R^1$, $R^2$, $R^3$, and $R^4$ in formula (XXIII) described above, an alkyl group having from 1 to 18 carbon atoms is preferred and as the substituted alkyl groups, an alkoxy group-substituted alkyl group having from 3 to 12 total carbon atoms and an aryloxy group-substituted alkyl group having from 7 to 21 total carbon atoms are preferred.

The aryl group shown by $R^1$, $R^2$, $R^3$, and $R^4$ may have a substituent and an aryl group having from 6 to 28 carbon atoms is preferred.

Of the urethane derivatives having at least 8 carbon atoms for use in the third embodiment of this invention, the urethane derivatives shown by following formulae (XXIV), (XXV) or (XXVI) are particularly preferred:

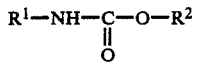

(XXIV)

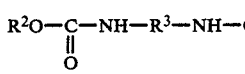

(XXV)

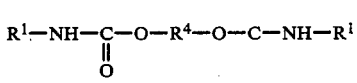

(XXVI)

In the above formulae, $R^1$ and $R^2$, which may be the same or different, each represents a substituted or unsubstituted alkyl group or a substituted or unsubstituted aryl group; $R^3$ represents an alkylene group, an allylene group, an aralkylene group, or an oxyalkylene group; and $R^4$ represents an alkylene group or an oxyalkylene group.

Of the alkyl groups shown by $R^1$ and $R^2$ in the aforesaid formulae (XXIV) to (XXVI), an alkyl group having from 1 to 18 carbon atoms is preferred and as the substituted alkyl group, an aryl group-substituted, alkoxy group-substituted, or aryloxy group-substituted alkyl group having from 7 to 21 total carbon atoms is preferred. Also, of the aryl groups shown by $R^2$, an aryl group having from 6 to 28 carbon atoms is preferred.

Specific examples of amide derivatives which can be used for the subbing layer in this invention are stearic acid anilide, stearic acid p-chloroanilide, stearic acid p-anisidide, stearic acid p-toluidide, stearic acid methylamide, phenoxyacetic acid stearylamide, 2-naphtoxyacetic acid stearylamide, phenylacetic acid stearylamide, phenylacetic acid stearylamide, phenylacetic acid benzylamide, benzoic acid stearylamide, p-chlorobenzoic acid stearylamide, p-chlorobenzoic acid γ-dodecyloxypropylamide, 1,3-bis(stearoylamino)propane, 1,6-bis(capryloylamino)hexane, 1,3-bis(phenylacetylaminomethyl)benzene, 1,3-bis(capryloylaminomethyl)cyclohexane, bis{4-(2-ethylhexanoylamino)cyclohexyl}methane, etc.

Specific examples of urea derivatives which can be used in this invention are 1-phenylurea, 1-methyl-3-phenylurea, 1-ethyl-3-phenylurea, 1,1-diethyl-3-phenylurea, 1-phenyl-3-propylurea, 3-phenyl-1,1-dipropylurea, 1-isopropyl-3-phenylurea, 1-isopropyl-3-phenyl-1-propylurea, 1,1-dipropyl-3-phenylurea, 1-butyl-3-phenylurea, 1,1-dibutyl-3-phenylurea, 1-isobutyl-3-phenylurea, 1-tert-butyl-3-phenylurea, 1-tert-butyl-1-methyl-3-phenylurea, 1-pentyl-3-phenylurea, 1,1-dipentyl-3-phenylurea, 1-tert-pentyl-3-phenylurea, 1-isopentyl-3-phenylurea, 1-phenyl-3-(1,2,2-trimethylpropyl)urea, 1-(1-ethyl-3-methylbutyl)-3-phenylurea, 1-(1-ethyl-2,2-dimethylbutyl)-3-phenylurea, 1-phenyl-3-(1,1,3,3-tetramethylbutyl)urea, 1-decyl-3-phenylurea, 1-(1-butylhexyl)-3-phenylurea, 1-(1-butyl-1-ethylpentyl)-3-phenylurea, 1-dodecyl-3-phenylurea, 1-octadecyl-3-phenylurea, 1-cyclohexyl-3-phenylurea, 1,1-dicyclohexyl-3-phenylurea, 1-(3-methoxypropyl)-3-phenylurea, 1-(3-cyclohexylpropyl)-3-phenylurea, 1-(p-methoxyphenyl)-3-butylurea, 1-(2-phenoxyethyl)-3-phenylurea, 1-benzyl-3-phenylurea, 1-(4-octadecyloxyphenyl)-3-phenylurea, 1-octadecylurea, 1-dodecyl-3-butylurea, 1-benzyl-3-butylurea, 1,1-diisobutyl-3-(1-napthyl)urea, 1,3-dioctadecylurea, 1,1-dimethyl-3-(2,4-xylyl)urea, 4,4'-bis(3-butylureido)diphenylmethane, 2,4-bis[3-(2-butoxyethyl)ureido]toluene, 1,6-bis(3-benzylureido)hexane, etc.

Specific examples of the urethane derivatives which can be used for the subbing layer in this invention are phenylcarbamoyloxydodecane, phenylcarbamoyloxyoctadecane, phenylcarbamoyloxymethylbenzene, octadecylcarbamoyloxymethylbenzene, 5-methyl-1-(phenylcarbamoyloxy)hexane, 1,4-bis(phenylcarbamoyloxymethyl)benzene, bis(2-phenylcarbamoyloxyethyl) ether, 1,3-bis(phenylcarbamoyloxy)propane, 1-phenoxy5-(phenylcarbamoyloxy)pentane, 1,6-bis(-phenylcarbamoyloxy)heptane, 1,2-bis(phenylcarbamoyloxy)cyclohexane, 4,4'-bis(ethoxycarbonylamino)diphenylmethane, 4,4'-bis(isopropoxycarbonylamino)diphenylmethane, 4,4'-bis(benzyloxycarbonylamino)diphenylmethane, 4,4'-bis(dodecyloxycarbonylamino)diphenylmethane, 2,4-bis(dodecyloxycarbonylamino)toluene, 1-(2-phenoxyethoxycarbonylamino)naphthalene, 1,5-bis(2-butoxyethoxycarbonylamino)naphthalene, 1,4-bis(ethoxycarbonylaminomethyl)benzyene, 1,6-bis(hexadecyloxycarbonylamino)heptane, 3,3'-bis(octadecyloxycarbonylamino)dipropyl ether, etc.

The addition amount of the aforesaid heat-fusible material is preferably from 1% by weight to 20% by weight to the pigment in subbing layer. If the amount is less than 1% by weight, the effect of this invention is not obtained and if the amount is over 20% by weight, the printing speed is lowered.

In a fourth embodiment of this invention, the subbing layer of the heat-sensitive recording material contains an aryl ether derivative having a melting point of at least 50° C. as the heat-fusing material having a melting point of at least 50° C.

Aryl ether derivatives which can be used in this invention are preferably the compounds shown by following formulae (XXVII) and (XXVIII):

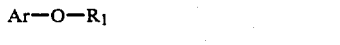

(XXVII)

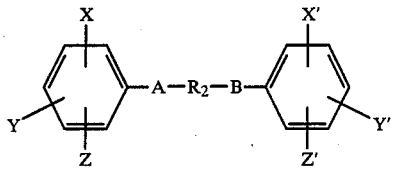

(XXVIII)

wherein Ar represents an aryl group; $R_1$ represents an alkyl group or an aryl group, which may be substituted; $R_2$ represents a divalent group; A and B each represents an oxygen atom, a sulfur atom,

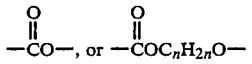

(wherein n represents an integer of from 1 to 5); and X, Y, Z, X', Y', and Z', which may be the same or different, each represents a hydrogen atom, an alkyl group, a hydroxy group, an alkoxy group, an alkylthio group, a halogen atom, an alkyloxycarbonyl group, an aryl group, or an acyl group, and X and Y or X' and Y' may combine to form a ring.

Examples of alkyl groups include a saturated or unsaturated alkyl group or cycloalkyl group and these groups may have at least one substituent such as an aryl group, an alkoxy group, an aryloxy group, an acyl group, a halogen atom, an acylamino group, an aminocarbonyl group, a cyano group, etc. Examples of aryl groups include a phenyl group, a naphthyl group or a heterocyclic aromatic group and these groups may have a substituent such as an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

Of the aryl groups shown by Ar, a phenyl group and a naphthyl group are preferred, and in particular an unsubstituted phenyl group and naphthyl group and also phenyl and naphthyl groups substituted by an alkyl group, an alkoxy group, an aryloxy group, a halogen atom, a phenyl group, or an acyloxy group are preferred.

Of the groups shown by $R_1$, an alkyl group having from 1 to 12 carbon atoms and an aryl group having from 6 to 20 carbon atoms are preferred, and in particular, an unsubstituted alkyl group and an alkyl group substituted by an alkoxy group, a halogen atom, an acyl group, or an aryl group are preferred. Of the groups shown by $R_2$, an alkylene group, an alkylene group having an ether bond, an alkylene group having a carbonyl group, an alkylene group having a halogen atom, and an alkylene group having an unsaturated bond are preferred, and in particular, an alkylene group and an alkylene group having an ether bond are preferred.

In regard to A and B in formula (XXVIII) described above, A and B are preferably simultaneously an oxygen atom or sulfur atom and A preferably is an oxygen atom and B is a sulfur atom or $$-\overset{\overset{\displaystyle O}{\|}}{C}O-.$$

Also, of the groups shown by X, Y, Z, X', Y', and Z', a hydrogen atom, an alkyl group, an alkoxy group, an alkyl thio group, a halogen atom and an acyl group are preferred. Furthermore, it is preferred for X and Y or X' and Y' to combine to form a naphthalene ring.

Specific examples of aryl ether derivatives shown by formulae (XXVII) and (XXVIII) described above β-phenetyl-p-biphenyl ether, β-naphthylbenzyl ether, bis(β-p-methoxyphenoxyethyl) ether, phenoxyacetic acid 4-chlorophenyl ester, β-naphthol(p-chlorobenzyl) ether, β-naphthol(p-methylbenzyl) ether, α-naphthylbenzyl ether, 1,4-butanediol-bis-p-methylphenyl ether, 1-β-naphthyloxy-2-phenoxypropane, 1,4-butandiol-p-isopropylphenyl ether, 1,4-butandiol-p-t-oxylphenyl ether, 2-phenoxy-1-p-tolyloxyethane, 1-phenoxy-2-(4-ethylphenoxy)ethane, 1-phenoxy-2-(4-chlorophenoxy)ethane, 1,4-butandioldiphenyl ether, (4,4'-methoxyphenylthio)ethane, 1,2-bis-m-tolyloxyethane, 1,2-diphenoxyethane, 1,5-bis(2-β- napthyloxyethoxy)-3-thiaheptane, bis(2-β-naphthyloxyethyl) carbonate, etc.

The amount of the heat-fusible material described above is preferably from 1% by weight to 20% by weight, and particularly not higher then about 10% by weight to the amount of pigment in the subbing layer. If the amount is less than 1% by weight, the effect of this invention is not obtained and if the amount is over 20% by weight, the printing speed is lowered.

In using the heat-fusible material described above for the subbing layer of the heat-sensitive recording material in the fourth embodiment of this invention, the heat-sensitive coloring layer may contain other heat-fusible materials as described above in regard to other embodiments of this invention but preferred heat-fusible materials which are used for the heat-sensitive coloring layers in the fourth embodiment are compounds having at least one aromatic ring and at least one ether, ester or carbonyl or compounds having at least one amide bond, urea bond, or urethane bond and having at least 10 total carbon atom numbers, these compounds having melting point of from 70° C. to 150° C. and solubility of water of lower than 25 at about 25° C.

Examples of these compounds are shown by following formulae (XXIX) to (XXXIII):

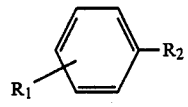

(XXIX)

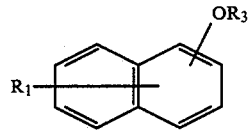

(XXX)

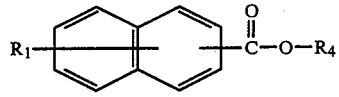

(XXXI)

$R_5NHCONH_2$ (XXXII)

$R_6CONH—R_7$ (XXXIII)

In the above formulae, $R_1$ represents a hydrogen atom, an alkyl group, an alkoxy group, a hydroxy group, an aryl group, or a halogen atom; $R_2$ represents an alkyl group, an alkoxy group, an acyl group, an alkoxycarbonyl group, or an aryloxycarbonyloxy group; $R_3$ and $R_4$ each represents an alkyl group and an aryl group; $R_5$ and $R_6$ each represents an alkyl group having from 12 to 24 carbon atoms, an aryloxymethyl group, a benzyl group; and $R_7$ represents a hydrogen atom or a phenyl group.

Also, when the phenyl group or benzyl group shown by $R_1$ to $R_4$ in formulae (XXIX) to (XXXIII) described above is substituted by a lower alkyl group, the number of carbon atoms thereof is from 1 to 8, and preferably from 1 to 3. Also, when the aforesaid group is substituted by a halogen atom, the halogen atom is preferably a fluorine atom. Furthermore, in formula (XXXI) described above, $R_4'$ is a hydrogen atom or a hydroxy group.

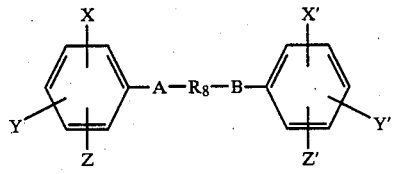

(XXXIV)

wherein A and B each represents an oxygen atom, a sulfur atom, —$CO_2$—, or —$CO_2C_nH_{2n}O$— (wherein n represents an integer of from 1 to 5); $R_8$ represents a divalent group such as, preferably, an alkylene group, an alkylene group having a carbonyl group, an alkylene group having a halogen atom, or an alkylene group having an unsaturated bond, and more preferably an alkylene group or an alkylene group having an ether bond; and X, Y, Z, X', Y' and Z', which may be the same or different, each represents a hydrogen atom, an alkyl group, an alkoxy group, a halogen atom, an alkyloxycarbonyl group, an acyl group, an alkylthio group, or a cyano group.

The compounds shown by formula (XXIX) to (XXXIV) described above have preferably a melting point of from 70° C. to 150° C., and more preferably from 80° C. to 140° C.

Specific examples of these heat-fusible materials are benzyl p-benzyloxybenzoate, β-naphthylbenzyl ether, stearic acid amide, palmitic acid amide, N-phenylearic acid amide, N-stearylurea, 8-naphthoic acid phenyl ester, 1-hydroxy-2-naphthoic acid phenyl ester, β-naphthol(p-chlorobenzyl) ether, β-naphthol(p-methylbenzyl) ether, α-naphthylbenzyl ether, 1,4-butanediol-p-methylphenyl ether, 1,4-propanediol-p-methylphenyl ether, 1,4-butanediol-p-isopropylphenyl ether, 1,4-butanediol-p-t-octylphenyl ether, 2-phenoxy-1-p-tolyloxy-ethane, 1-phenoxy-2-(4-ethylphenoxy)ethane, 1-phenoxy-2-(4-chlorophenoxy)ethane, 1,4-butanediol-phenyl ether, diethylene glycol-bis(4-methoxyphenyl) ether, p-ethylphenoxyacetic acid benzylamide, phenylacetic acid benzylamide, acetylbiphenyl, benzylbiphenyl, ditricarbonate, etc.

These heat-fusible materials may be used alone or as a mixture thereof and for obtaining a sufficient heat response, the amount thereof is preferably from 10 to 200% by weight, and more preferably from 20 to 150% by weight to the developer in the heat-sensitive coloring layer.

In a fifth embodiment of this invention, the subbing layer of the heat-sensitive material contains a heat-fusible organic material having melting point of at least 50° C. as described hereinabove in the first embodiment of this invention and, in particular, the heat-sensitive coloring layer thereof contains a pigment having an oil absorptiveness of at least 80 cc/100 g defined by JIS-K5101.

As described hereinbefore, the subbing layer of the heat-sensitive recording layer contains a pigment and such a pigment usually has an oil absorptiveness of at least 40 cc/100 g defined by JIS-K5101, such as, preferably, calcium carbonate, barium sulfate, titanium oxide, talc, agalmatolite, kaolin, calcined kaolin, aluminum hydroxide, amorphous silica, a urea-formalin resin powder, a polyethylene resin powder, etc.

Also, according to this invention, the subbing layer and the heat-sensitive coloring layer of the heat-sensitive recording material contain a heat-fusible material(s) having melting point of at least 50° C. However, more preferred dot reproducibility is obtained when the subbing layer thereof contains the aforesaid heat-fusible material and the heatsensitive coloring layer contain the pigment defined in this invention.

Examples of pigments having an oil absorptiveness of at least 80 cc/100 g, and more preferably at least 100 cc/100 g, defined by JIS-K5101, which is incorporated in the heat-sensitive recording layer of the heat-sensitive recording material in the fifth embodiment of this invention include calcined kaolin, amorphous silica, diatomaceous earth, magnesium carbonate, barium carbonate, a urea-formaldehyde resin filler, etc.

The method of production of a typical heat-sensitive recording material of this invention is explained in general below.

A pigment and the heat-fusible material having a melting point of at least 50° C. are separately ground and each dispersed in a dispersion medium. As the dispersion medium, an aqueous solution of a water-soluble polymer or binder at a concentration of from about 0.5 to 10% by weight is generally used. The dispersions obtained are mixed with each other at an appropriate ratio and, if desired, various additives are added thereto to provide a coating composition for the subbing layer.

The coating composition is coated on a support at a coverage of from 1 to 20 g/m$^2$, and preferably from 2 to 10 g/m$^2$ and dried to provide an undercoated base paper.

Then, a color former and a developer as described above are separately ground into particle sizes of about 10 μm, and preferably about 3 μm or less in each dispersion medium and dispersed therein. The dispersion medium can be an aqueous solution of water-soluble polymer or binder at a concentration of from about 0.5 to 10%. For the dispersion, a ball mill, a sand mill, an attritor, a colloid mill, etc., can be used.

The weight ratio of the color former to the developer used is preferably from 1/10 to 1/1, and more preferably from 1/5 to ¾.

The heat-fusible material having a melting point of at least 50° C. as described above is added to the dispersion. In this case, the heat-fusible material may be added to each of the dispersion of the color former and the dispersion of the developer or to the mixture of both the dispersions. Also, if desired, additives are added to the dispersion.

For example, for preventing staining of the recording head at recording, an oil absorptive material such as an inorganic pigment, a polyurea filler, etc., can be used and further to improve the head releasing property, a fatty acid, a metal soap, etc., is added.

Furthermore, if desired, an antistatic agent, an ultraviolet absorbent, a defoaming agent, a conductive agent, a fluorescent dye, a surface active agent, etc., may be added to the dispersion.

As the binder and the pigment for the heat-sensitive coloring layer, the materials described hereinbefore for the subbing layer can be used with the exception of the pigment in the fifth embodiment of this invention described above, wherein the pigment having an oil absorptiveness of at least 80 cc/100 g is used.

Zinc stearate, calcium stearate, aluminum stearate, etc., can be used as a metal soap.

Also, to impart water resistance to the binder, a waterproofing agent (e.g., a gelling agent, a crosslinking agent) or an emulsion of a hydrophobic polymer such as a styrene-butadiene rubber latex, an acrylic acid emulsion, etc., may be employed. The coating composition for the heat-sensitive coloring layer is coated on the subbing layer described above at from about 2 to 10 g,/m$^2$.

Furthermore, if desired, a protective layer composed of a water-soluble or water-dispersible polymer such as polyvinyl alcohol, hydroxyethyl starch, and epoxy-denatured polyacrylamide and a crosslinking agent is formed on the surface of the heat-sensitive coloring layer at a thickness of from 0.2 to 2 μm for improving the fastness of the heat-sensitive recording material.

Moreover, the heat-sensitive recording material of this invention may include the various embodiments as described in West German Patent Application (OLS) Nos. 2,228,581, 2,110,854, Japanese Patent Publication No. 20142/77, etc. Also, pre-heating, humidity control, or stretching of the support may be employed during recording.

The following examples are given to illustrate this invention in greater detail but are not to be construed to limit the invention in any way.

EXAMPLE 1

Preparation of Heat-Sensitive Coating Composition

Each of 20 g of 2-anilino-3-methyl-N-methyl-N-cyclohexylaminofluoran as a color former, 20 g of bisphenol A as a developer, and 20 g of β-naphthylbenzyl ether as a heat-fusible material (or sensitizer) was separately dispersed in 100 g of an aqueous solution of 5% polyvinyl alcohol (PVA-105, trade name, made by Kuraray Co., Ltd.) for an entire day and night using a ball mill to form dispersions of each having a mean volume particle size of 3 μm or less. Then, 80 g of amorphous silica (Mizukasil P-832, trade name, made by Mizusawa Kagaku Kogyo K.K.) as a pigment was dispersed in 160 g of an aqueous 0.5% sodium hexametaphosphate solution using a homogenizer. Then, 5 g of the dispersion of the color former, 10 g of the dispersion of the developer, 10 g of the dispersion of the heat-fusible material, and 15 g of the dispersion of amorphous silica were mixed and then 3 g of an emulsion of 21% zinc stearate, 2 g of an emulsion of 30% paraffin wax (Hidrin D-337, trade name, made by Chukyo Yushi K.K.) and 0.2 g of an emulsion of 40% 1,1,3-tris(2-methyl-4-hydroxy-5-tert-butylphenyl)butane (Hidrin E-161, trade name, made by Chukyo Yushi K.K.) were added to the mixture to provide a coating composition for the heat-sensitive coloring layer.

Preparation of Undercoated Base Paper

An undercoated base paper was prepared as follows.

After dispersing 80 g of a calcined kaolin (Ansilex 90, trade name, made by Engelhard Minerals & Chemicals Corp.) as a pigment in 160 g of an aqueous solution of 0.5% sodium hexametaphosphate by a homogenizer, 8 g of 48% styrene-butadiene latex (made by Sumitomo Norgatac Co.) and 6 g of a dispersion of β-napthylbenzyl ether as a heat-fusible material were added to 60 g of the dispersion thus obtained to provide a coating composition. The coating composition was coated on a wood free paper having a basis weight of 50 g/m$^2$ at a dry coated amount of 6 g/m$^2$ using a wire bar and dried in an oven at 50° C. to provide a base paper having a subbing layer. Then, the above-described heat-sensitive coating composition was coated on the subbing layer at a dry coated amount of 6 g/m$^2$ using a wire bar and dried in an oven at 50° C. to provide a heat-sensitive recording material.

EXAMPLE 2

By following the same procedure as in Example 1 except that 3 g of an emulsion of 30% paraffin wax (Hidrin D-337, trade name, made by Chukyo Yushi K.K.) as a heat-fusible material was used for the subbing layer in place of 6 g of the dispersion of β-napthylbenzyl ether, a heat-sensitive recording material was obtained.

EXAMPLE 3

By following the same procedure as in Example 1 except that 2 g of an emulsion of 40% 1,1,3-tris(2-methyl-4-hydroxy-5-tert-butylphenyl)butane (Hidrin E-161, trade name, made by Chukyo Yushi K.K.) was used as a heat-fusible material for the subbing layer in place of 6 g of the dispersion of β-naphthylbenzyl ether, a heat-sensitive recording material was obtained.

EXAMPLE 4

By following the same procedure as in Example 1 except that the heat-sensitive coating composition and subbing layer were prepared using N-benzylphenylacetylamide in place of β-naphthylbenzyl ether, a heat-sensitive recording material was obtained.

EXAMPLE 5

By following the same procedure as in Example 1 except that the heat-sensitive coating composition and subbing layer were prepared using bis(2-p-methoxyphenoxyethyl)ether in place of β-naphthylbenzyl ether, a heat-sensitive recording material was obtained.

EXAMPLE 6

By following the same procedure as in Example 1 except that the heat-sensitive coating composition was prepared using calcined kaolin (Ansilex 90, trade name, made by Englehard Minerals & Chemicals Corp.) in place of amorphous silica, a heat-sensitive recording material was obtained.

COMPARATIVE EXAMPLE 1

By following the same procedure as in Example 1 except that the heat-sensitive coating composition was prepared using kaolin (Kaobrite) in place of amorphous silica, a heat-sensitive recording material was obtained.

COMPARATIVE EXAMPLE 2

By following the same procedure as in Example 1 except that the heat-sensitive coating composition was prepared using bis(2-p-methoxyphenoxyethyl) ether in place of β-naphthylbenzyl ether, a heat-sensitive recording material was obtained.

COMPARATIVE EXAMPLE 3

By following the same procedure as in Example 1 except that the dispersion of β-naphthylbenzyl ether was not added to the subbing layer, a heat-sensitive recording material was obtained.

COMPARATIVE EXAMPLE 4

By coating the heat-sensitive coating composition described above on a wood free paper of 50 g/m$^2$ in basis weight without a subbing layer, a heat-sensitive recording material was obtained.

The color density and the dot reproducibility of the samples thus obtained were measured as follows.

A print was formed on each sample using a print test machine made by Kyocera Corporation at a printing energy of 30 mJ mn$^2$ and the color density was measured with a Macbeth densitometer.

Also, a dot print was formed on each sample by a print test machine made by Kyocera Corporation at a printing energy of 25 mJ/mm$^2$, the areas of 40 dots were obtained using an image analyzer, and the vale of the standard deviation of the area divided by the mean value of the areas was used as dot reproducibility. A lower value shows better dot reproducibility.

The results obtained are shown in Table 1 below.

TABLE 1

| Samples | Pigment in Heat-Sensitive Coloring Layer (Oil Absorption) | Heat-Fusible Material in Heat-Sensitive Coloring Layer (m.p.) | Heat-Fusible Material in Subbing Layer (m.p.) | Color Density | Dot Reproducibility | Fog Density |
|---|---|---|---|---|---|---|
| Example 1 | Amorphous Silica (140) | β-Naphthylbenzyl Ether | β-Naphthylbenzyl Ether (101° C.) | 1.05 | 0.063 | 0.08 |
| Example 2 | Amorphous Silica (140) | β-Naphthylbenzyl Ether | Paraffin Wax (68° C.) | 1.00 | 0.070 | 0.07 |
| Example 3 | Amorphous Silica (140) | β-Naphthylbenzyl Ether | 1,1,3-Tris(2-methyl-4-hydroxy-5-tert-butylphenyl)butane (180° C.) | 1.07 | 0.065 | 0.07 |
| Example 4 | Amorphous Silica (140) | N—Benzylphenylacetylamide (123° C.) | N—Benzylphenylacetylamide | 0.85 | 0.072 | 0.08 |
| Example 5 | Amorphous Silica (140) | Bis(2-p-methoxyphenoxyethyl) ether | Bis(2-p-methoxyphenoxyethyl) ether (101° C.) | 1.12 | 0.060 | 0.08 |
| Example 6 | Calcined Kaolin (100) | β-Naphthylbenzyl Ether | β-Naphthylbenzyl Ether | 1.08 | 0.068 | 0.08 |
| Comparative Example 1 | Kaolin (40) | β-Naphthylbenzyl Ether | β-Naphthylbenzyl Ether | 0.99 | 0.112 | 0.08 |
| Comparative Example 2 | Amorphous Silica (140) | Bis(2-p-methoxyphenoxyethyl) ether | β-Naphthylbenzyl Ether | 1.10 | 0.064 | 0.13 |
| Comparative Example 3 | Amorphous Silica (140) | β-Naphthylbenzyl Ether | none | 0.94 | 0.101 | 0.08 |
| Comparative Example 4 | Amorphous Silica (140) | β-Naphthylbenzyl Ether | No subbing layer | 0.82 | 0.132 | 0.08 |

As shown by the results in Table 1 above, it can be seen that the samples of this invention containing heat-fusible materials defined in this invention in both the subbing layer and the heat-sensitive coloring layer thereof have excellent color density and dot reproducibility as compared with comparison samples without a heat-fusible material in the subbing layer or without any subbing layer.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a subbing layer mainly composed of a pigment and a binder, and a heat-sensitive recording layer containing a color former and a developer together with a binder, wherein said subbing layer and said heat-sensitive recording layer each contains a heat-fusible material having a melting point of at least 50° C., and wherein the heat-fusible material is a compound represented by one of the following formulae:

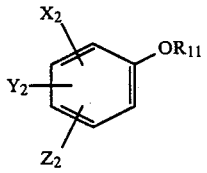

(VI)

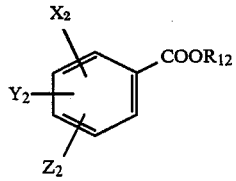

(VII)

$R_{13}CONHR_{14}$ (VIII)

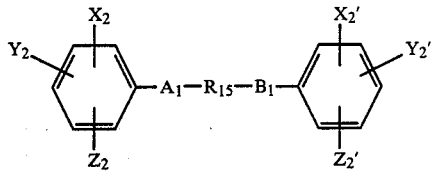

(IX)

wherein $R_{11}$, $R_{12}$ and $R_{13}$, which may be the same or different, each represents an alkyl group or an aryl group; $R_{14}$ represents a hydrogen atom, an alkyl group, or an aryl group; $R_{15}$ represents a divalent group; $A_1$ and $B_1$, which may be the same or different, each represents O, CO, $CO_2$, or S; and $X_2$, $Y_2$, $Z_2$, $X_2'$, $Y_2'$ and $Z_2'$, which may be the same or different, each represents a hydrogen atom, an alkyl group, an aryl group, an alkoxy group, a halogen atom, an alkoxycarbonyl group, an acyloxy group, or an alkylthio group; $X_2$ and $Y_2$ or $X_2'$ and $Y_2'$ may combine to form a ring.

2. The heat-sensitive recording material as claimed in claim 1, wherein the subbing layer and the heat-sensitive coloring layer contains the same heat-fusible material having melting point of from 70° C. to 130° C.

3. The heat-sensitive recording material as claimed in claim 1, wherein the heat-sensitive coloring layer contains a pigment having an oil absorptiveness, of at least 80 cc/100 g.

* * * * *